US006100440A

United States Patent [19]

Tumiatti et al.

[11] Patent Number: 6,100,440

[45] Date of Patent: Aug. 8, 2000

[54] PROCESS FOR THE DECONTAMINATION AND TREATMENT WITH OXIDATIVE COUNTERFLOW OF A LIQUID, GASEOUS OR SOLID MATRIX

[75] Inventors: Wander Tumiatti, Rivoli, Italy; Shubhender Kapila, Rolla, Mo.

[73] Assignee: Sea Marconi Technologies di Wander Tumiatti S.a.s., Turin, Italy

[21] Appl. No.: 09/029,129

[22] PCT Filed: Aug. 21, 1996

[86] PCT No.: PCT/EP96/03682

§ 371 Date: Jun. 8, 1998

§ 102(e) Date: Jun. 8, 1998

[87] PCT Pub. No.: WO97/07858

PCT Pub. Date: Mar. 6, 1997

[30] Foreign Application Priority Data

Aug. 25, 1995 [IT] Italy ..... TO95A0702

[51] Int. Cl.[7] ..... A62D 3/00

[52] U.S. Cl. ..... 588/205; 588/206; 588/207; 588/215; 588/218; 588/238; 588/242

[58] Field of Search ..... 588/206, 205, 588/207, 215, 218, 238, 242; 252/182.12, 182.35; 502/46, 414; 208/262.1, 262.5; 431/5, 7, 170; 110/346

[56] References Cited

U.S. PATENT DOCUMENTS 4,967,673 11/1990 Gunn ..... 110/346
5,663,479 9/1997 Tumiatti ..... 588/206
5,705,140 1/1998 Johansing, Jr. ..... 423/490

FOREIGN PATENT DOCUMENTS 0 118 858 9/1984 European Pat. Off. .
0 135 043 3/1985 European Pat. Off. .
0 451 006 10/1991 European Pat. Off. .
WO 94/14504 7/1994 WIPO .
WO 95/18667 7/1995 WIPO .

*Primary Examiner*—Steven P. Griffin
*Assistant Examiner*—Eileen E. Nave
*Attorney, Agent, or Firm*—Seidel, Gonda, Lavorgna & Monaco, PC

[57] ABSTRACT

The process includes the steps of filling a first reactor (10) with a particulate support (22) comprising a solid matrix to be decontaminated and treated, or a matrix impregnated by a liquid or gaseous matrix to be decontaminated and treated; and introducing at one end (23) of the reactor (10) an oxidative flow triggering a thermoxidation reaction at the opposite end (24) in such a manner that a mobile flame front (26) is generated in the direction opposite (28) to the oxidative flow. The flame front has a temperature of at least 1200° C. so as to substantially decompose or destroy contaminants, undesired substances and compounds initially present in the matrix. Preferably, prior to triggering the thermoxidation reaction, the particulate support (22) is mixed and/or treated with a decontaminating reagent.

17 Claims, 11 Drawing Sheets

PROCESS FOR THE DECONTAMINATION AND TREATMENT WITH OXIDATIVE COUNTERFLOW OF A LIQUID, GASEOUS OR SOLID MATRIX

This application is the National Stage filed under 35 U.S.C. 371 of PCT/EP96/03682, filed Aug. 21, 1996.

FIELD OF THE INVENTION

This invention refers to a decontamination and treatment process for a liquid, gaseous or solid matrix, containing contaminants, undesired substances or compounds.

BACKGROUND OF THE INVENTION

Numerous organic contaminants represent a danger to the environment and public health. Some classes of organic contaminants, (i.e. halogenated substances) have a high priority for concern, due to their chemical inertness and resistance to natural degradation in the environment. Halogenated substances maintain characteristics of persistency, harmfulness and toxicity for a long time (decades), with the possibility of bio-accumulation in various living species, posing permanent damage to living organism and in mankind. Some of these halogenated compounds (i.e. PCDDs and PCDFS) also present carcinogen, teratogen and mutagen risks.

In the last decades several methods for the treatment and the disposal of halogenated organic compounds have been proposed, such as controlled thermodestruction and the use of "secure" landfills. However, it has been found that, for the disposal of materials contaminated by toxic and halogenated compounds, these methods are not completely satisfactory, especially on large scales, and when the recovery of recyclable materials is desirable. In some instances, the correct disposal of wastes containing these compounds is impossible, since some countries are totally lacking in appropriate disposal systems (i.e. currently Italy).

Several chemical processes for the decomposition of halogenated organic compounds have been developed. Pytlewski and Smith, in their U.S. Pat. Nos. 4,337,368 and 4,236,090, demonstrated that polyhalogenated organic compounds were decomposed by reaction with a pre-formed organo-sodium reagent, such as sodium naphthalenide, NaPEG. In these ceases, the use of metallic sodium metal requires special handling procedures and specialized equipment. Even mere traces of water in suspension must be eliminated, so as to avoid dangerous side reactions that could cause explosions and fires.

Later, Brunelle of General Electric, in U.S. Pat. Nos. 4,351,718 and 4,353,793, proposed the removal of polychlorinated aromatic hydrocarbons dissolved in an organic solvent, such as transformer oil, by creating the solution with a mixture of polyethylene glycol or monocapped polyalkyleneglycol alkyl ether and an alkali metal hydroxide.

It has been found that such reactions require extended periods of time to reduce the concentration of halogenated contaminants, such as polychlorinated biphenyls (PCB's), to a level generally acceptable by the regulations effective in various countries.

Peterson of Niagara Mohawk Power Corporation in U.S. Pat. No. 4,532,028 proposed to reduce the level of halogenated aromatics in a hydrocarbon stream by treatment with an alkaline reactant in a sulfoxide solvent. This process involves a further purification step to remove the sulfoxide solvent, after decontamination. The resulting decontaminated fluid is reused.

In U.S. Pat. No. 4,632,742 and Eur. Pat. No. 0 118 858, Tundo disclosed a method for the decomposition of halogenated organic compounds by a reagent which consists of (a) polyethylene glycol, Nixolens®, an alcohol or polyhydroxy compounds, (b) a base, such a carbonate or bicarbonate of an alkali metal or an alkaline earth carbonate and (c) an oxidative agent, such as $Na_2O_2$ and $BaO_2$, or a source of radicals in the absence of oxygen. This method is applicable to the decontamination of mineral oil, soil and various porous surfaces. But the use of sodium peroxide, or other oxidative agents, and the use of a source of free radicals, poses potential explosion and fire hazards. Also, this method can be prohibitively expensive because of the cost of peroxide.

Further, in U.S. Pat. No. 4,839,042 and Eur Pat No. 0 135 043, Tumiatti et al. described a continuous decontamination process with a dehalogenation bed, which is composed of a polyethylene glycol or a copolymer of various alkene oxides in a certain proportion, and an alkali alcoholate or alkaline earth. The components are adsorbed on certain solid carriers. However, this process was found to require a large amount of reagent and extended periods of time to reduce the concentration of halogenated contaminants, such as PCBs, to a generally acceptable level prescribed by current regulations.

In the Application for patent PCT/EP93/03609 dated Dec. 20, 1993, published on Jul. 7, 1994 as WO94/14504, Tumiatti presented a process for the removal of halogenated organic compounds from fluid and solid contaminated matrices, which allows the functional recovery of such fluids (mainly dielectric mineral oils in operation in electric transformers). The dangerous substances are easily decomposed from materials usable according to this dehalogenation process. The halogenated organic compounds are rapidly and completely decomposed by a reagent consisting in a non-alkali metal, a polyalkyleneglycol or a Nixolens® and a hydroxide or a $C_1$–$C_6$ alcoholate of alkali metal or alkaline earth. This dehalogenating reagent overcomes the aforementioned deficiencies and gives more effective results than obtained by prior art methods using a reagent produced from an oxidative agent or a source of radicals. The dehalogenating reagent can be directly mixed with a fluid or solid matrix contaminated by halogenated organic compounds, under stirring and at a pre-selected temperature typically from 20° C. to 150° C. (preferably from 70° to 120° C.). The use of ultrasound and UV sources in the dehalogenation process increases the efficiency of the reaction 10–15%, and decreases the duration about 25%.

In particular, the reagent of WO94/14504, combined with porous solid supports (i.e. pumice), can become a fixed bed for the continuous removal of halogenated organic compounds in fluids contaminated by PCBs, by using a device of appropriate shape and dimension, such as a column and cartridge or a series of cartridges.

With the introduction of the dehalogenation process just described and its subsequent industrialization, it became desirable to find an optimized solution to improve the operation of the dehalogenation reagent. It also became desirable to provide for the recovery of the materials used to support the reagent, after the chemical dehalogenation of the PCBs and/or the destruction of the oxidized organic compounds, as an alternative to the traditional methods of disposal of the wastes generated.

Moreover, the industrial application of the decomposition process described above is not conveniently applied, or is totally inapplicable, to certain situations. Such situations include, for example, the destruction of ASKAREL (pure PCBs, or PCBs in mixtures with trichlorobenzene), oils highly contaminated by PCBs or halogenated substances, other contaminated synthetic fluids (i.e. silicones and esters), solids (soil, recyclable metals from machinery/equipment highly contaminated and destined to disposal by thermodestruction), and water based and gaseous matrices.

SUMMARY OF THE INVENTION

The process of the present invention as described herein is provided with the purpose of satisfying the requirements described above and avoiding the inconvenience evident in previously known techniques.

The process of the invention can be defined as "an oxidative counterflow", which includes a phase where the front of a flame propagates in a first reactor in the direction opposite to the oxidative flow in the reactor. As a result of this feature, it is possible to accurately pilot the thermoxidation reaction in the reactor, to completely destroy contaminants, undesired substances and compounds, and to obtain harmless reaction products.

The particulate support in the practice of the invention can be the solid matrix to be treated, such as, for example, soil impregnated by hydrocarbons, or the particulate support may be an adsorbent support which has been impregnated in the first reactor with a liquid or gaseous matrix to be decontaminated, prior to starting the thermoxidation reaction. The process of this invention is therefore useful for the treatment of liquid, gaseous and solid matrices.

In a process such as the process of the present invention, the most important critical factors are: the loss of material being treated, the cost of the energy required, the variation of the adsorbing capability of the supports, and the destructive efficiency of the reacting materials. The process of the invention has been surprisingly demonstrated to be intrinsically self-cleaning and practically self-sustaining. It does not require the application of outside energy, but only requires the priming energy necessary to start the thermoxidation reaction. Moreover, the process maintains, and even improves in time, the physical integrity of the particulate support with a negligible effect on its surface and adsorbent capability.

It was observed that it is possible to apply the process of the invention in an efficient and economically advantageous manner to a large range of highly contaminated matrices that the prior art processes described above were not capable of properly treating.

The present invention represents, therefore, an effective and economic alternative to existing methods for the disposal of matrices contaminated by highly toxic or persistent organic compounds by controlled thermodestruction. The existing methods require large fixed installations and considerable investments. They are characterized by considerable operational costs, due mostly to high energy consumption. This causes a strong environmental impact and considerable logistic problems, deriving from the transportation and handling of large quantities of wastes, as well as difficult social relations with the population and/or political and administration authorities involved.

In a preferred form of implementation of the process of the invention, prior to the priming of the thermoxidation reaction, the particulate support is mixed and/or treated with a decontaminating reagent including at least one of the components (A), (B) and (C), representing (A) one or more metals or their oxides, (B) a polyalkyleneglycol or a Nixolens® and (C) a hydroxide, a $C_1$–$C_6$ alcoholate, a carbonate or bicarbonate of alkali metal or alkaline-earth.

Non-limiting examples of matrices that can be decontaminated and treated with the process of the invention, are:

- water, i.e. drinking, drainage, process or cooling water;
- other liquids, such as solvents, chemical intermediates, or process or food fluids; oil or fluids with a dielectric, diathermic, hydraulic, or lubricating function; fluids with a mineral, vegetable, animal or synthetic base; or mixtures thereof;
- air, such as air from the workplace, from the environment itself, or from a process;
- technical or process gas;
- solids, such as an adsorbing or filtering support; a process support; earth; soil; equipment components or complete equipment;
- wastes or residue, such as urban, special, toxic, harmful or medical wastes;
- bio-filters.

Non-limiting examples of contaminants, undesired substances and compounds, that can be treated both in a pure form or diluted with the process of the invention, are:

- halogenated aromatic compounds, such as for example, PCBs, PCDDs, PCDFs, PBBs, DDTs, DDEs;
- dangerous organic compounds; toxic, harmful, carcinogenic, teratogenic, or mutagenic compounds; and dangerous pollutants, chlorofluorocarbons, sulfur hexafluoride or polyaromatic hydrocarbons;
- aggressive chemical agents, bacteriological agents, viruses, retroviruses, fungi and their mixtures, which are carried on liquid, gaseous, solid or biological matrices;
- derivatives of polar, oxidized or degraded by-products.

In particular, the process of the invention can be applied to treat a matrix containing exhausted waste reagent used in the decomposition of halogenated components, of the type described in WO94/14504. In this case, a surprising synergy is produced between the factors critical to the success of chemical decontamination and the success of thermoxidation. It is also possible to recover materials otherwise destined for disposal.

The process of the invention which achieves regeneration and/or recycling of the above reagents (which are eventually used on a support for industrial dehalogenation, with the complete destruction of undesired organic compounds) is based upon the inter-reaction of the reagents, that maintain a sufficient rheologic capability, with the adsorbent supports and with the oxidative counterflow system.

The process of the invention is carried out in a reactor where a zone of high temperature thermo-oxidation or flame front is activated and maintained by air or oxygen delivered from the base of a column containing the materials being treated. The flame front propagates in the direction opposite to the direction of the oxidative flow, toward the entering oxidative agent. The flame front generated by the process progressively gasifies a fraction of the materials to be treated and produces volatile compounds and a porous residue. The residue is regenerated and can be reused repeatedly. The thermal energy generated during the process is elevated. The process produces a mixture composed mainly of carbon monoxide, carbon dioxide, hydrogen and hydrocarbons. In the thermoxidation zone, temperatures up to about 1,500° C. are obtained. The residual carbon produced by the thermoxidation process can also be used as an adsorbent support for the removal of contaminants. The residual carbon, as it is repeatedly re-used, acquires a highly porous surface much higher in porosity than carbon in its initial state. The carbon becomes extremely more efficient as an adsorber. It is also free of tar. The highly reactive atmosphere in the high temperature thermoxidation zone is capable of virtually destroying all organic compounds. This, together with the adsorbing nature of the carbon support, allows the complete destruction of residues of organic products left in the supports or reagents treated.

More generally, the process of the invention solves a series of important problems connected with the prevention of environmental damage and the conservation and/or the recovery of vital resources. The problems solved include, but are not limited to, the following:

- detoxification of a large variety of halogenated organics, such as polychlorinated biphenyls (PCBs) Askarel fluids, polyaromatic hydrocarbons, polychlorinated-dibenzo-p-dioxins (PCDDs), polychlorinated-dibenzo-furans (PCDFs), polybrominated biphenyls (PBB's), chlorofluorocarbons (CFCs), dichloro-diphenyltrichloroethane (DDTs), 2,4,5 trichloro-phenole, polyhalogenated alkylbenzene, sulfur hexafluoride and others;
- elimination of polar and oxidation by-products from oils and fluids (such as in the regeneration of dielectric, diathermic and other oils);
- regeneration of inorganic supports and recovery of resources and metals from exhausted reagents, and from contaminated equipment destined for disposal (such as electric transformers and capacitors and other machines); and
- decontamination of soil polluted by hydrocarbons and dangerous organic substances.

The process of the invention is compatible with the environment and offers the unique opportunities of an integrated and flexible system, requiring limited investments for the realization of mobile or fixed operating configurations. The system may be coupled with other chemical/physical treatment equipment/processes in various operational scenarios with specific contaminants and/or their mixtures.

A regenerated particulate support obtainable at the end of a decontamination and treatment process, as previously described, constitutes a further subject of this invention.

DESCRIPTION OF THE FIGURES

Further advantages and characteristics of this invention will be evident from the detailed description that follows with reference to the attached nonlimiting drawings.

FIG. 6B, 10%; FIG. 6C, 20% and then subjected to the process of the invention as illustrated by Example 1.

FIG. 9A, 5% Askarel Coke/reagent (upward counterflow); FIG. 9B: 10% Askarel Coke/reagent (upward counterflow); and FIG. 9C: 20% Askarel in Coke/reagent upward flow. FIG. 10A: 5% Askarel in Coke/reagent (counterflow followed by forward flow); FIG. 10B: 10% Askarel in Coke/reagent (counterflow followed by forward flow); and FIG. 10C: 20% Askarel in Coke/reagent (counterflow followed by forward flow).

DETAILED DESCRIPTION OF THE INVENTION

Figure 1:
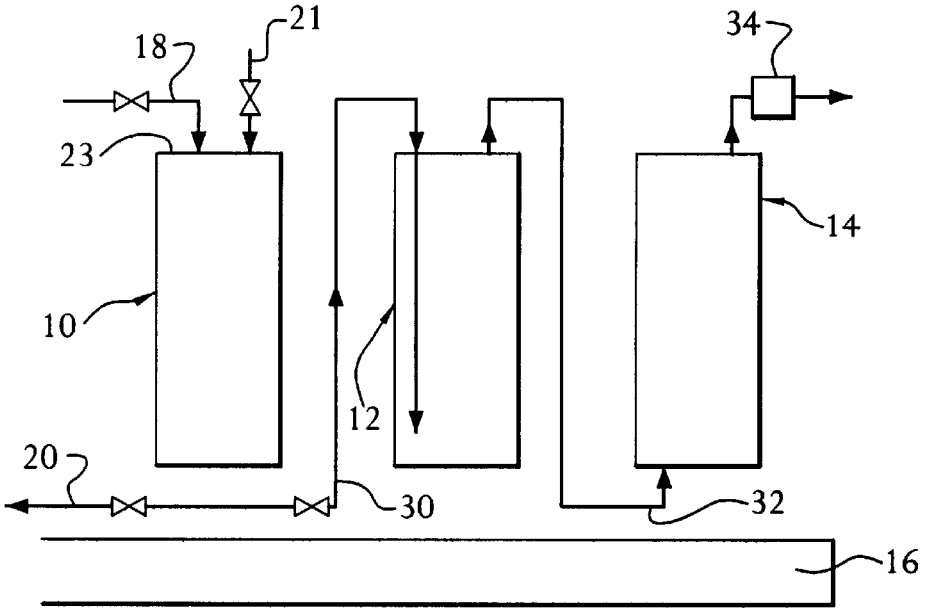
FIG. 1 represents a diagram of a system for the performance of the process of the invention.

A decontamination and treatment system includes (FIG. 1) a first reactor 10, a second reactor 12 and a third reactor 14 arranged in series. A pan 16 is located under the reactors to contain leaks. Preferably, reactors 10, 12, 14 are of the column type and have a length/diameter ratio between 2 and 25. In practical industrial arrangements, the reactors 10, 12, 14 may be in a modular form and may include several modules connected in parallel, as required to optimize the effectiveness and efficiency of the process.

The first reactor 10 is equipped with ducts 18, 20 respectively for the inlet and outlet of a fluid matrix to be decontaminated and a duct 21 for the introduction at one of its ends 23 of an oxidative flow, such as air or oxygen.

Figure 2:
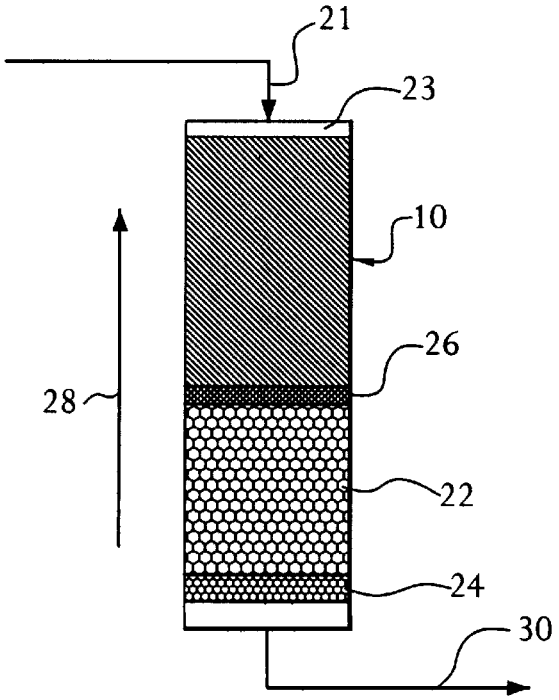
FIG. 2 is a more detailed diagram of a reactor forming a part of the system of FIG. 1.

The first reactor 10 is filled (FIG. 2) with a particulate support 22, preferably a porous support selected from the group consisting of coal, coke, active carbon, activated and non alumina, silica gel, fuller's earth, diatomaceous earth, pumice, zeolite, perlite, molecular sieves, the above dehalogenation reagent, silicates, functionalized and nonfunctionalized ceramic, sand, clay, metal powders, metal oxides, filtration media, vegetable media, and mixtures thereof. The average granular size of particulate support 22 is preferably between 0.01 and 250 mm.

In a first phase of the process of the invention, a fluid matrix to be treated flows through reactor 10, and passes through ducts 18, 20 in such a manner that support 22 becomes impregnated, preferably up to saturation, by contaminants, undesired substances and compounds present in the fluid matrix. Depending upon the requirements, the fluid matrix flow may be top to bottom, as indicated in FIG. 1, or vice versa.

Should the fluid matrix contain halogenated organic compounds, the impregnated support 22 can also be mixed or treated with a decontaminating reagent as described above, in particular a dehalogenating-type reagent as described in WO94/14504 the disclosure of which is incorporated herein by reference in this description.

A polyalkylene glycol useful in the above dehalogenating reagent preferably has the following formula (I):

(I)

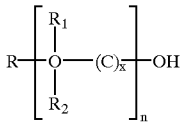

wherein x is ≧2; n is an integer of 1 to 500; R is hydrogen, a straight or branched-chain $C_1$–$C_{20}$ alkyl group, an aralkyl group, or an acyl group; $R_1$ and $R_2$, which can be the same or different, represent hydrogen, a straight or branched-chain $C_1$–$C_{20}$ alkyl group, a $C_5$–$C_8$ cycloalkyl group, or an optionally substituted aryl group.

The polyalkylene glycol is preferably Carbowax® 6000.

Nixolens® is a trademark for a series of random copolymers of various alkene oxides in different proportions, which are distributed by the Italian ENICHEM (Milan) Company. They are useful in the practice of the present invention because of their high chemical activity and physical character. Nixolens®, a common industrial lubricant fluid, includes Nixolens®-NS, Nixolens®-VS and Nixolens®-SL. Of these, Nixolens®-VS is preferred, such as VS-13, VS-40 and VS-2600, which contains a low percentage of propylene oxide monomers and a relatively high percentage of ethylene oxide monomers.

The alcoholate is preferably a $C_1$–$C_6$ alcoholate of an alkali metal or an alkaline-earth metal.

When a polyalkyleneglycol or a copolymer of alkene oxides, having an average molecular weight more than 6000, is combined with a non-alkali metal and a hydroxide or an alcoholate, a very efficient dehalogenation is obtained. This is especially true for lower halogenated contaminants, such as PCBs in Aroclor® 1242, 1254, mixtures, and for numerous halogenated alkylbenzenes.

The mole ratio of polyalkyleneglycol or Nixolens® to halogen varies from 1:1 to 30:1, and the mole ratio of hydroxide or alcoholate to halogen ranges from 10:1 to 200:1. At this mole ratio, the concentration of the non-alkali metal in the reaction mixture, which consists of the decomposition reagent and the contaminated matrix, ranges from about 0.02% to 5% by weight, preferably 0.1% to 2% by weight. In particular, when the decontaminating reagent is used to decompose halogenated organic compounds in a contaminated solid matrix such as sludge, a relatively large amount of polyalkyleneglycol or Nixolens® is employed to serve as both solvent and reagent. In general, the amount of the reagent depends upon the type and amount of halogenated contaminants present.

The decontaminating reagent and the particulate support 22 can also be pre-formed on functionalized beds in the form of columns or cartridges of the appropriate form and dimensions. The particular form and dimensions are selected in view of the different matrices, contaminants, undesired substances and compounds to be treated.

Naturally, should it be required to treat a granular solid matrix contaminated by undesired compounds or substances, such as soil impregnated by hydrocarbons or a granular support impregnated by a spent waste decontaminating reagent, the solid is directly loaded into reactor 10 without performing the impregnation. Treatment with fresh decontaminating reagent is performed, with the purpose of causing a removal of, and/or primary decomposition of, the contaminants immobilized and/or adsorbed on the particulate support.

The matrix to be decontaminated and treated can be mixed with the decontaminating reagent with the aid of a mechanical means and ultrasound, and may be irradiated by a source of ultra-violet rays.

The impregnation and treatment phases carried out with the decontaminating reagent occur at a temperature preferably between ambient temperature and about 200° C.

At the end of the impregnation and treatment phases, the oxidative flow from duct 21 is activated (FIG. 2) at the end 23 of reactor 10, and a thermoxidation reaction is primed at the opposite end 24. The reaction may be primed with, for example, an electric heater or a propane torch. Thus, a mobile flame front 26 is generated in the opposite direction (indicated by arrow 28) to that of the oxidative flow. The flame front has a temperature of at least 1200° C., with specific thermal parameters depending upon the nature of the eventual decontaminating reagents used and the type and quantity of the undesired compounds to be treated.

In particular, the temperature of the flame front or thermoxidation zone can exceed 1500° C. and generate thermal/oxidative degradation with the mineralization of organic contaminants adsorbed or present in the particulate support 22. The movement of the front 26, as well as the residential time of more traditional thermal degradation processes (such as incineration), is controlled by oxidative flow. The front is maintained in each section of the first reaction 10 for preferably between 2 and 10 seconds.

The thermal energy required by the thermoxidative reaction is primarily generated by the oxidation of the organic contaminants themselves, leaving the particulate support 22 in good measure intact, even if it is made of a carbonaceous material. This allows the regeneration of carbonaceous adsorbents such as granulated active carbon, coke or other carbonaiceous absorbents. The support regenerated in the zone behind the flame front 26 is also capable of removing organic contaminants that escape the thermodestruction, giving the process of the invention its special and surprising self-cleaning characteristic. Moreover, the process is substantially self-sustained and energetically self-contained, since no energy is supplied by external sources during normal operation.

The exhaust gases and the particulate flowing out of the first reactor 10 can typically contain acid compounds (chlorinated, sulphured, fluoridated and others) depending upon the type and concentration of the initial contaminants. The exhaust gases and particulate can contain by-products derived from incomplete oxidation, especially during the transitional priming phase, and eventually can contain micro pollutants.

Consequently, in order to neutralize these compounds, the exhausted gases are bubbled, passing through a duct 30, to the bottom of second reactor 12. The reactor is filled with a basified liquid, such as water, a hydrocarbon, polyalkyleneglycol, Nixolens® or mixture thereof.

The basified liquid can also be recirculated (in a manner not illustrated in the figures) through an adsorbing trap made of a particulate support— such as active carbon, activated alumina, pomice or the like—thereby filtering and/or adsorbing the decontaminating reagent. The liquid is ultimately circulated through a heat exchanger to recover energy.

Once the activity of the basified liquid contained by the second reactor 12 and by the trap is exhausted, the flow of gas coming from the first reactor 10 is stopped and the content of the trap and the second reactor 12 is transferred into the first reactor 10, where it is subject to an oxidative counterflow treatment. At the same time, the second reactor 12 can be loaded with fresh basifying liquid and can be supplied again with gas coming from the first reactor 10.

In order to assure the maximum level of protection for the operators and the environment, the gaseous flow leaving the second neutralizing reactor 12 is taken by a line 32 into third reactor 14 which is filled preferably with a porous adsorbing support, e.g. active carbon or a mixture of active carbon, activated alumina and the like. This final stage has the purpose of eliminating eventual micro traces of environmental unfriendly substances, such as, e.g. sulphured compounds that can generate bad odours, as well as traces of micro pollutants, even if they have already been reduced by the preceding reactors 10, 12 to levels below the thresholds prescribed by current regulations or measurable by instruments. The gas flowing out the third reactor 14 can be directed through a pyrolytic torch 34 prior to discharge into the atmosphere.

Once the porous support in the third reactor 14 is saturated by the substances adsorbed, the feeding of gases from the second reactor 12 is stopped and the third reactor 14 is regenerated, by priming an oxidative counterflow similar to what was described with reference to the first reactor 10. As an alternative, the porous support of the third reactor 14 can be loaded into the first reactor 10, where it is subjected to the oxidative counterflow process.

As a whole, therefore, the product obtained by the process of the invention as the gaseous effluent of torch 34 is completely free of contaminants and undesired substances or compounds. The particulate support 22 is regenerated and remains in first reactor 10, where it can be reused for a new decontamination treatment cycle, or removed for further use.

According to a variant of the process of the invention, when the flame front reaches the end 23 of the first reactor 10, a new priming of the thermoxidation reaction is generated, so that the flame front now moves in a downward direction, in conjunction with the oxidative flow, after the first phase as a counterflow.

During this second phase of thermoxidation, the flame consumes all the carbon mass (contaminants, residual reagent and eventual carbonaceous material present in the support) thereby obtaining the total destruction of the contaminants adsorbed. The adoption of this variant of the process, not allowing the regeneration of the carbonaceous particulate support, obviously depends upon the specific requirements of the treatment operation.

The following non-limiting examples of the application of the process of this invention are provided.

EXAMPLE 1

Regeneration and Recovery of Supports and Exhausted Reagents Used for Chemical Dehalogenation Decontaminating reagents used for chemical dehalogenation in particular, as described in WO94/14504, have emphasized an exploitation that is typically evaluated around a 10:25% of their effective potential or rheologic capacity. This limitation derives from the necessity of maintaining the decontaminating agents at a level of saturation with respect to the residual concentration of halogenated aromatic compounds (i.e. PCBs) within the limits prescribed by current regulations for their classification as special waste, avoiding that they are subject to the limitations and costs related to the possession, transportation and disposal of toxic/harmful wastes. With the disposal, that includes an intrinsic cost, recyclable materials are also lost, such as particulate solids eventually used to support such reagents.

In contrast, the coupling of the process of the invention relative to the regeneration and recovery of used reagents in known chemical dehalogenation processes, especially in mobile units, allows full exploitation of the reagent and its subsequent on-site treatment, without generating practically any waste. To meet the stated objectives, four sets of experiments were undertaken, including:

a) characterization and quantization of exhausted waste reagent at a saturation level about 15 times higher than the current typical value, to determine the level of residues of PCBs, PCDDs, PCDFs, polyethyleneglycols (PEG), chlorine and sodium/potassium;

b) examination of the destruction efficiency of the process of the invention on residual PCBs;

c) determination of the efficiency of mineralization;

d) determination of the area of the adsorbing surface of the support of exhausted reagent by electron microscope examination.

Analysis of Residual PCBs in Exhausted Reagent Sludge

The following experimental procedure was carried out:

1 gram of exhausted reagent was dissolved in 100 ml of methanol. A known amount of methanol was introduced into a silica-gel column for a clean up with 40 ml of methylene chloride. The extract was rotary evaporated and twice solvent exchanged with 20 ml of iso-octane. Final volume was fixed to 2 ml by a $N_2$ stream. Aliquots were analyzed for residual PCBs by high resolution gas chromatography.

A capillary gas chromatograph equipped with an electron capture detector was used. Separation of PCB congeners was carried out with 30 m×0.25 mm fused silica tubing with 95% methyl+5% phenyl polysiloxane stationary phase. A calibration curve for concentration ranges for analysis of PCBs was provided. In addition, a known amount of Aroclor® 1242 was added to the extract in order to identify separate components. Chromatographic peaks were identified by relative retention time matching with pentachlorobenzene. Quantization of PCBs was carried by peak area measurement relative to an external calibration standard on the basis of percent contribution of individual chlorobiphenyls to Aroclor® 1242.

Carbon Regeneration

Figure 3:
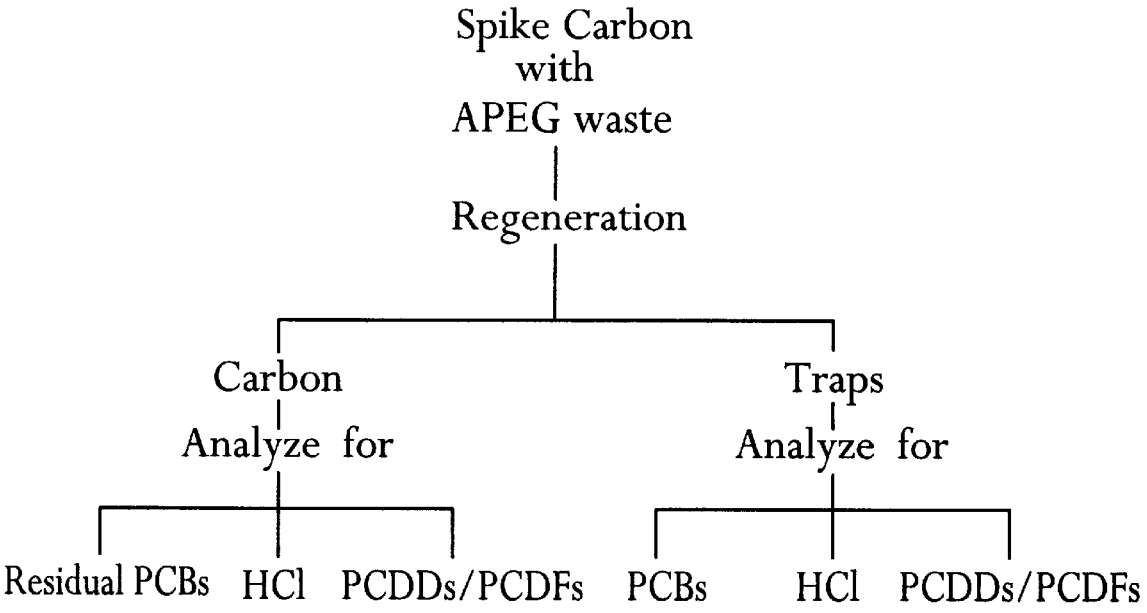
FIG. 3 is a flow diagram, on which a material balance has been based according to Example 1 hereof.
Figure 4:
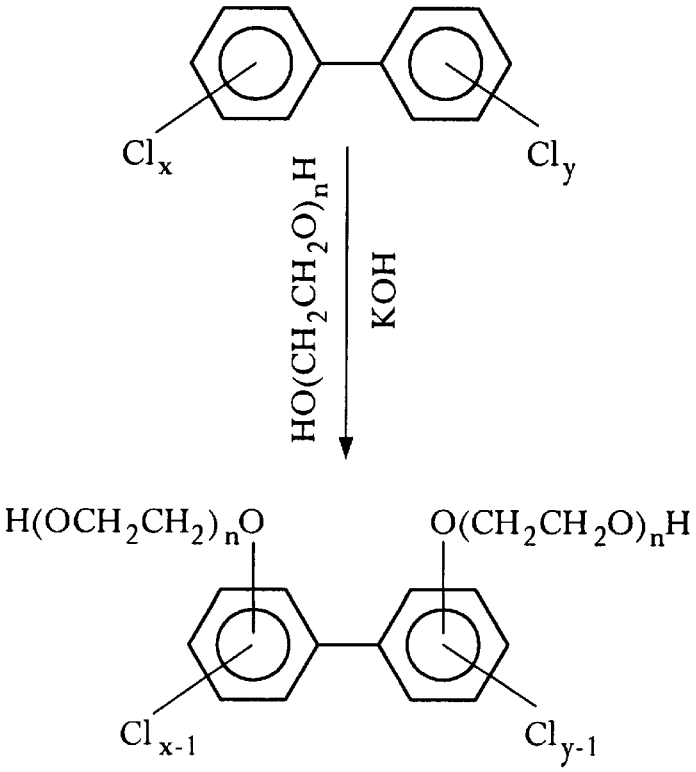
FIG. 4 is a dehalogenation reaction diagram for the reaction of Example 1.

A material balance approach (FIG. 3) was adopted to document PCBs destruction efficiency and to monitor the formation of possible oxygenated by-products, especially PCDDs and PCDFs, and evolved hydrochloric acid, during the process of the invention. The likely overall reactions leading to the decomposition of PCBs are presented in FIG. 4:

PCBs (C—Cl)+$O_2$+Carbon (C)→Carbon (C-Oxides)+Residual PCBs (C—Cl)+By-products (C—Cl)+By-products (C—Cl—O)+$HCl_{(g)}$.

Gasification and Analysis of PCBs and PCDDs/PCDFs on Carbon

An aliquot of activated carbon impregnated by a known amount (5%, 10%, or 20% w/w) of waste dehalogenation reagent was packed into a reactor and subject to the oxidative counterflow process of the invention. The reactor was made of a column having dimensions 25 mm diameter and 250 mm height, connected by transfer glass lines and a glass bowl functioning as a water scrubber, and two 25 ml containers used as gas traps. The oxidative flow was 2 l/min of oxygen inlet from the top of the column; pressure 2 bar; temperature 1500° C.; time of counterflow cycle 3 minutes. The priming was triggered in the lower part of the column with a propane torch. After regeneration, a 1 g of aliquot of carbon was Soxhlet extracted with 250 ml of benzene for at least 20 hours to remove strongly adsorbed components on carbon. The extract was cleaned up by passage through a silica-gel column with 40 ml of methylene chloride and reduced to approximately 3 ml with a rotary evaporator and then concentrated down to 2 ml by a $N_2$ stream.

The cleaned extract was analyzed with a gas chromatograph and low resolution mass spectrometer interfaced to a high resolution capillary gas chromatography.

Determination of Residual PCBs, Possible Oxygenated Products and HCl in Traps

The traps and transfer lines were first rinsed with deionized water, and the rinse was pooled with water from impinger traps. The pooled water was twice extracted with hexane. The traps and transfer lines were also rinsed with hexane. The extracted liquid was used for chloride determination. Hydrochloridric acid was analyzed by an ion chromatograph (Model 14, Dionex, Sunnyvale, Calif.) equipped with ion resin columns (separator and suppressor column). The samples were quantitated by peak response relative to a standard chlorine solution. The hexane extract was dried by passage over anhydrous sodium sulphate. The dried extract was split into two potions. One portion was used for determination of total residual PCBs. The other potion was used for determining planar PCBs and PCDDs/PCDFs. For these analyses, the hexane extract was extracted with DMSO (dimethylsulfoxide). The DMSO extract containing planar PCBs and PCDDs/PCDFs was back-extracted with 10% benzene in hexane. The benzene/hexane extract was fractioned using a multilayered adsorbent column to remove interfering agents. The analysis of the PCBs and PCDDs/PCDFs was performed by gas chromatography and gas chromatography/mass spectrometry.

Carbon Mass Loss

This study was carried out under the optimum temperature (i.e. about 1500° C.) to achieve minimal carbon mass loss, and to produce regenerated carbon equal in adsorption capacity to virgin carbon, while at the same time maintaining acceptable destruction efficiency for adsorbed waste reagents. For this reason, careful attention was paid to the loss of carbon during the regeneration process. Mass loss was measured as a function of oxygen flow rate and the different loading rate of waste reagent added to carbon.

Surface Area Determination and Scanning Microscopic Examination

The change in total surface area of the regenerated carbon was determined with the BET method. The method measures the activated carbon's adsorption and desorption of nitrogen under varying conditions. The BET surface area determination was carried out on a Quantasorb QS-10 nitrogen adsorption surface area analyzer (Quantachrome Corp. Syosset N.Y.).

Results and Evaluation

The experimental studies were carried out to determine residual PCBs in activated carbon impregnated by waste dehalogenation reagent—i.e. carbon used to treat dielectric oil contaminated by PCBs—and then subject to the process of this invention.

Figure 5:
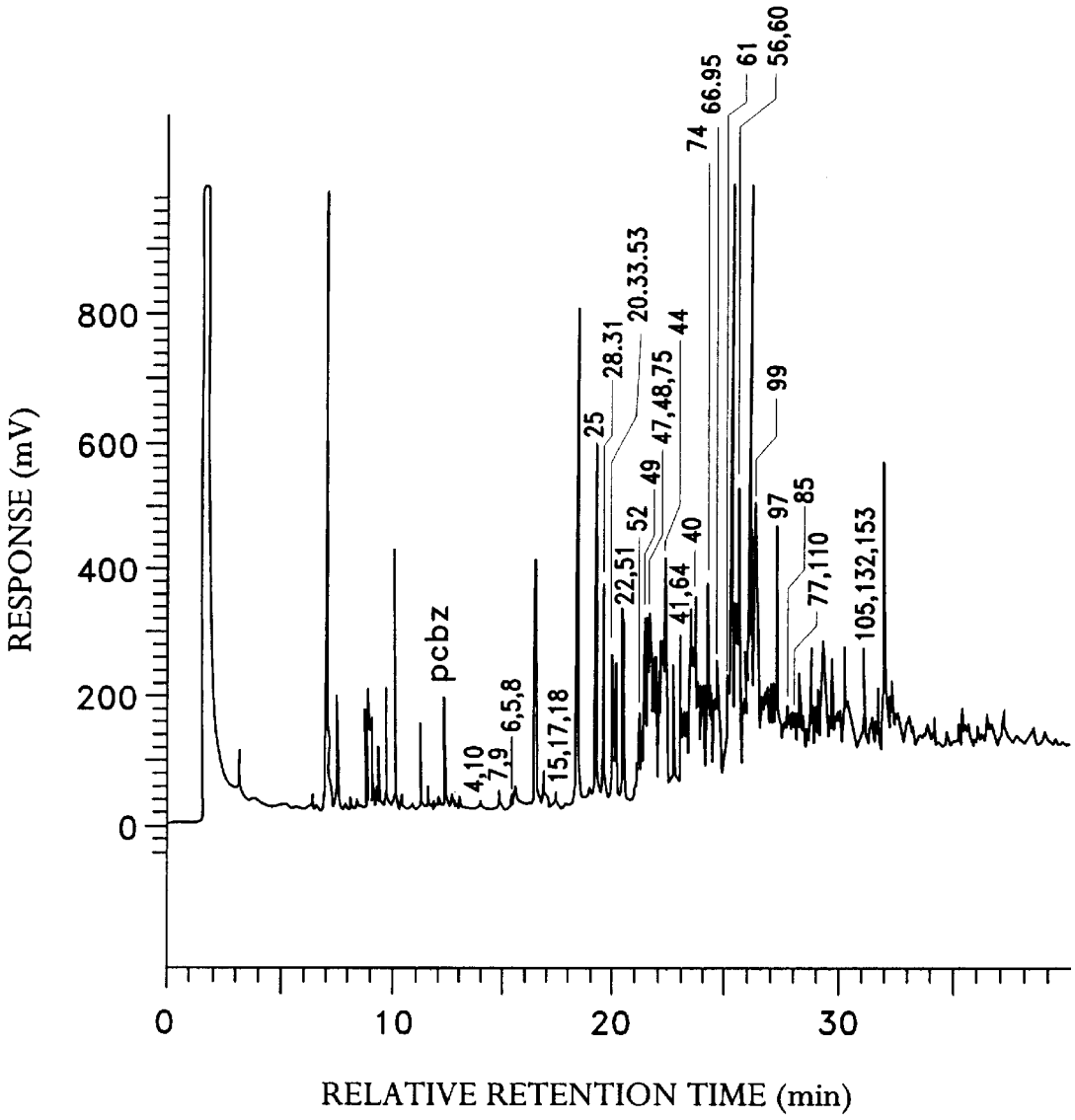
FIG. 5 is a chromatogram of the residues of PCBs in a typical exhausted waste dehalogenation reagent as illustrated by Example 1 hereof.

Higher chlorinated PCBs congeners (such as Aroclor 1254 and 1260) are extremely reactive toward nucleophilic aromatic substitution with the above dehalogenation reagent. In a reaction with potassium hydroxide and PEG functioning as a nucleophile, lower chlorinated PCBs are formed. Lower chlorinated PCBs are more easily biodegradable. As expected, the chromatographic profile (FIG. 5) of residual PCBs in the waste dehalogenation reagent closely resembles that of Aroclor 1242. For this reason, the quantitative analysis of PCB congeners in the dehalogenation reagent residue was identified with Aroclor 1242, based on the weight percent contribution of individual chlorobiphenyls. The concentration of each PCB congener, measured in the dehalogenation reagent residue to be adsorbed on activated carbon and subject to the process of this invention, are demonstrated in Table 1. The results indicate that the total concentration of residual PCBs is approximately 774 mg/kg. It was observed that the relative concentration of trichlorobiphenyls, with respect to the total polychlorinated biphenyls, constitutes roughly 30%. The relative concentration of tetrachlorobiphenyls was about 45%, and the relative concentration of pentachlorobiphenyls was about 20%.

The development of the oxidative counterflow process included the optimization of variables such as oxygen flow rate, temperature and residue reagent loading rate with respect to activated carbon. Development of the process involved, in particular, balancing two parameters: minimization of the carbon mass loss and maximization of the destruction efficiency of residual PCBs in adsorbed waste reagent.

Figure 6A:
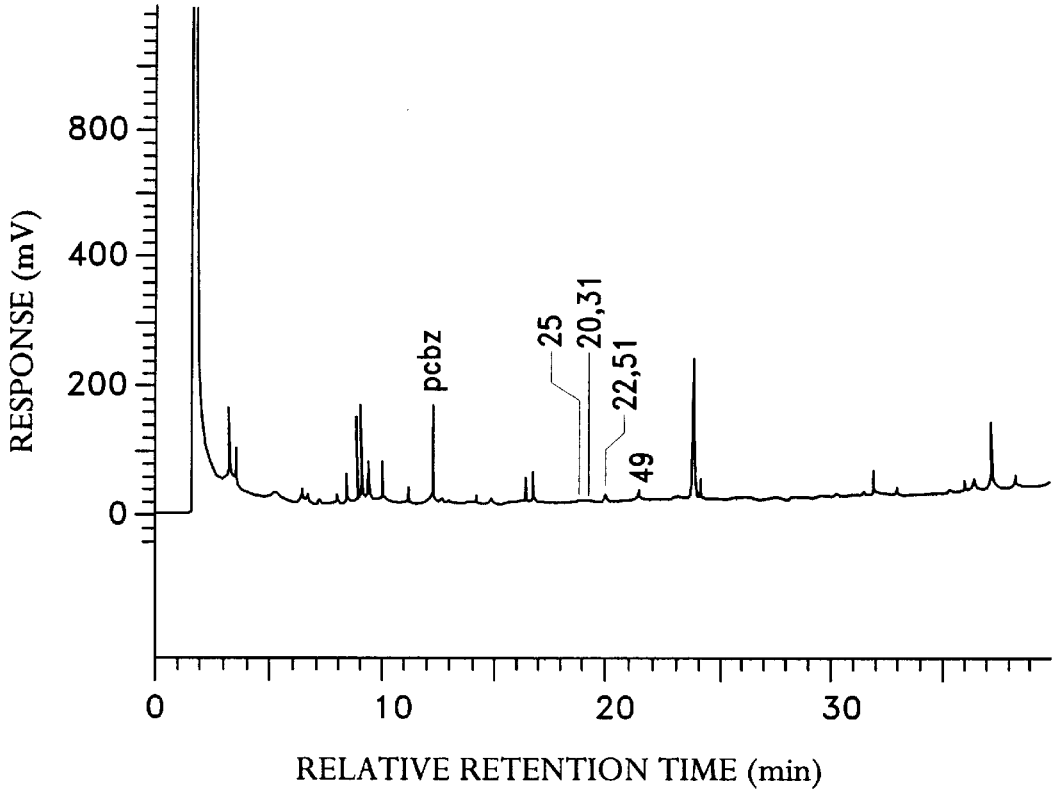
FIGS. 6A, 6B and 6C illustrate chromatograms of residues of PCBs in active carbon which was initially impregnated with various proportions of waste dehalogenation reagent FIGS. 6A, 5%.
Figure 6B:
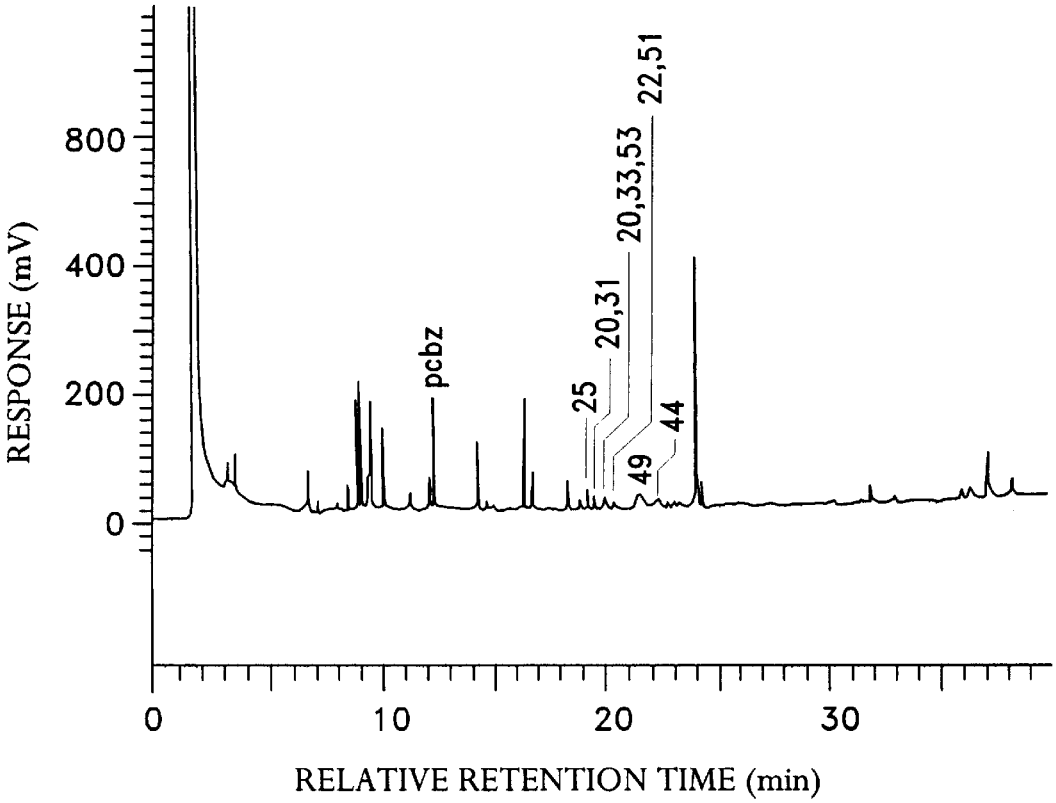
Figure 6C:
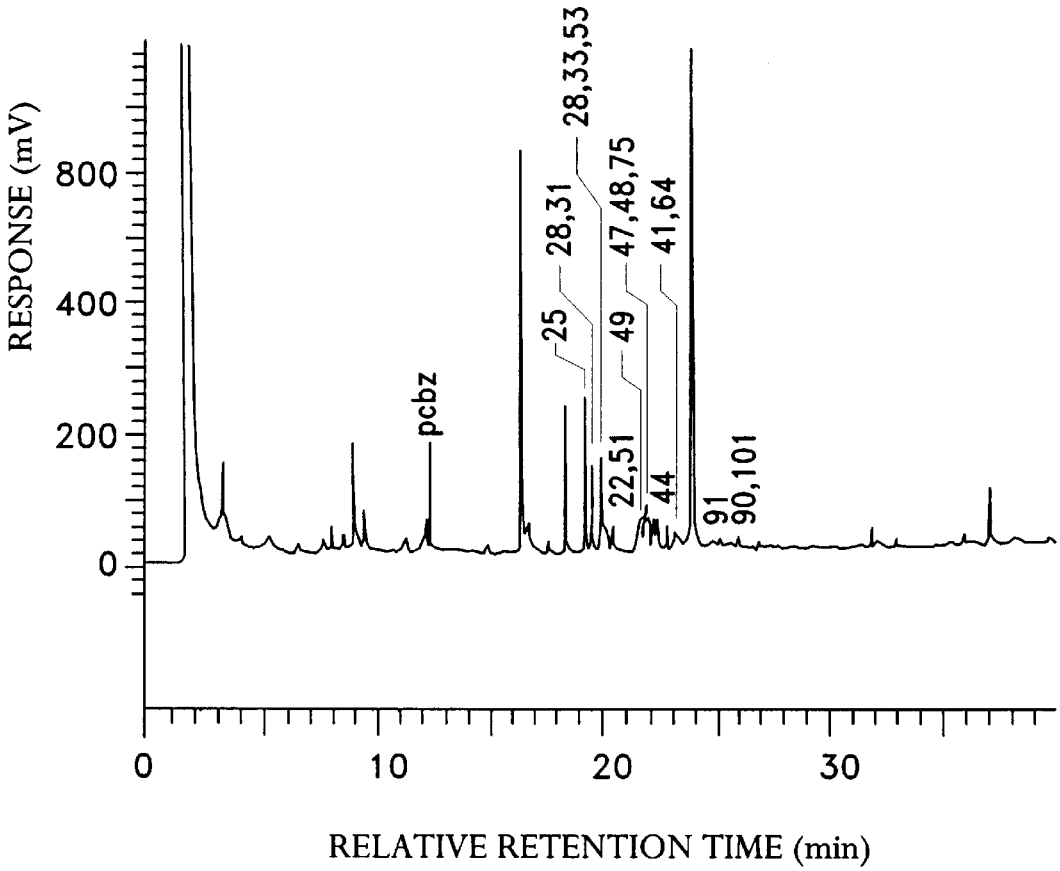

Experiments were carried out over a 5 to 20% loading range of waste dehalogenation reagent with respect to activated carbon, to evaluate the two parameters above mentioned. Gas chromatographic data for destruction efficiency after the oxidative counterflow process are shown in FIGS. 6A, 6B and 6C.

As already mentioned, Table 1 demonstrates the concentration of PCBs congeners found in a waste dehalogenation reagent, whereas Table 2 shows the concentrations of a few such congeners in activated carbon impregnated by this reagent and subsequently subjected to the oxidative counterflow process of the invention.

A comparison of Tables 1 and 2 shows that the PCB congeners are destroyed with efficiencies of 96% or better. Destruction efficiencies progressively increase as the loading of spent reagent is reduced from 20% through 5%.

Figure 7:
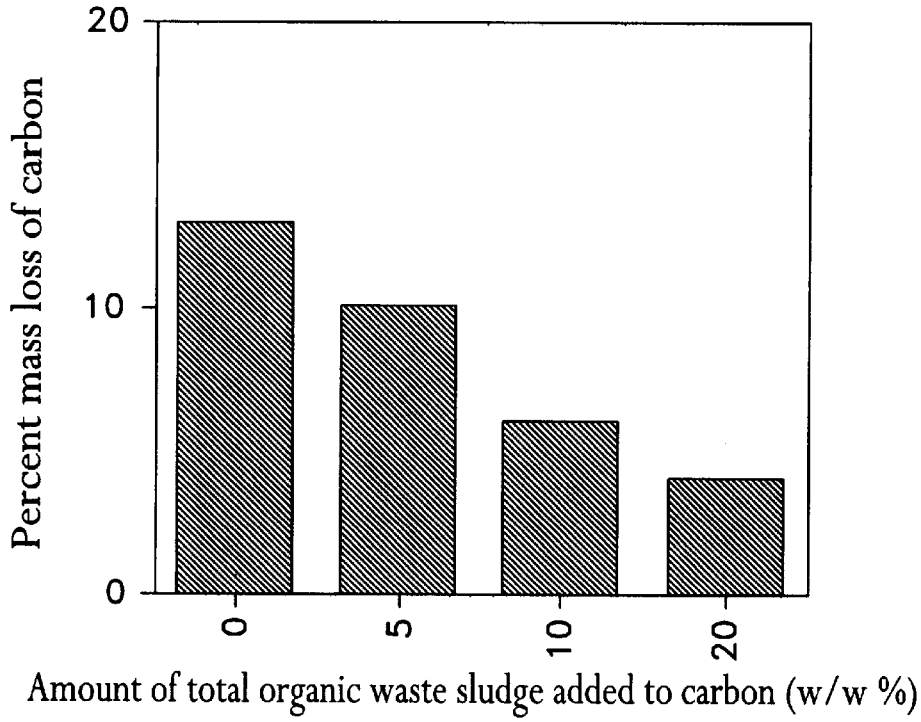
FIG. 7 is a diagram illustrating the percentage of the loss of mass by carbon subject to the process of the present invention as a function of the load of spent reagent added to the carbon according to Example 1.
Figure 8:
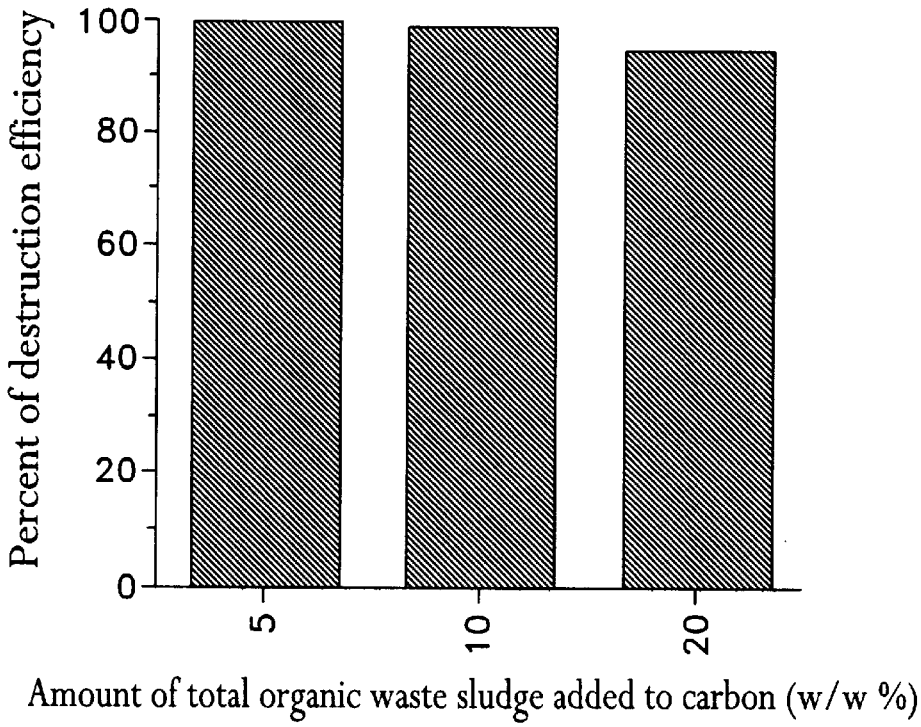
FIG. 8 is a diagram illustrating the destructive efficiency of the process of the invention as a function of the load of reagent added to the carbon, according to Example 1.
Figure 9A:
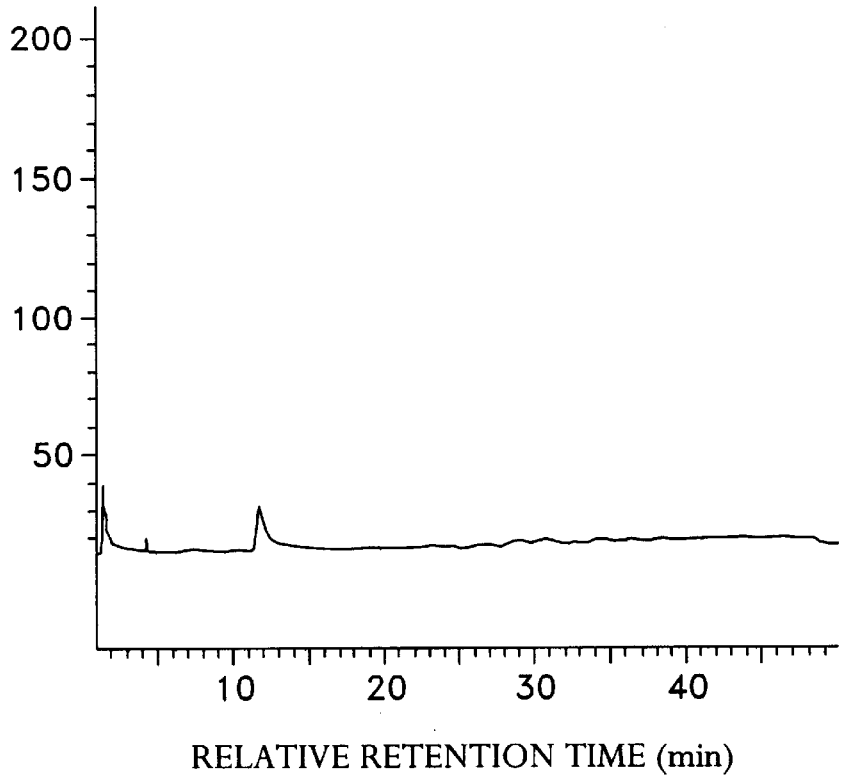
FIGS. 9A, 9B, 9C and FIGS. 10A, 10B, 10C represent chromatograms of residues of PCBs after the application of the process of the invention to mixtures of different proportions of Askarel and dehalogenation reagent supported by coke (Example 2).
Figure 9B:
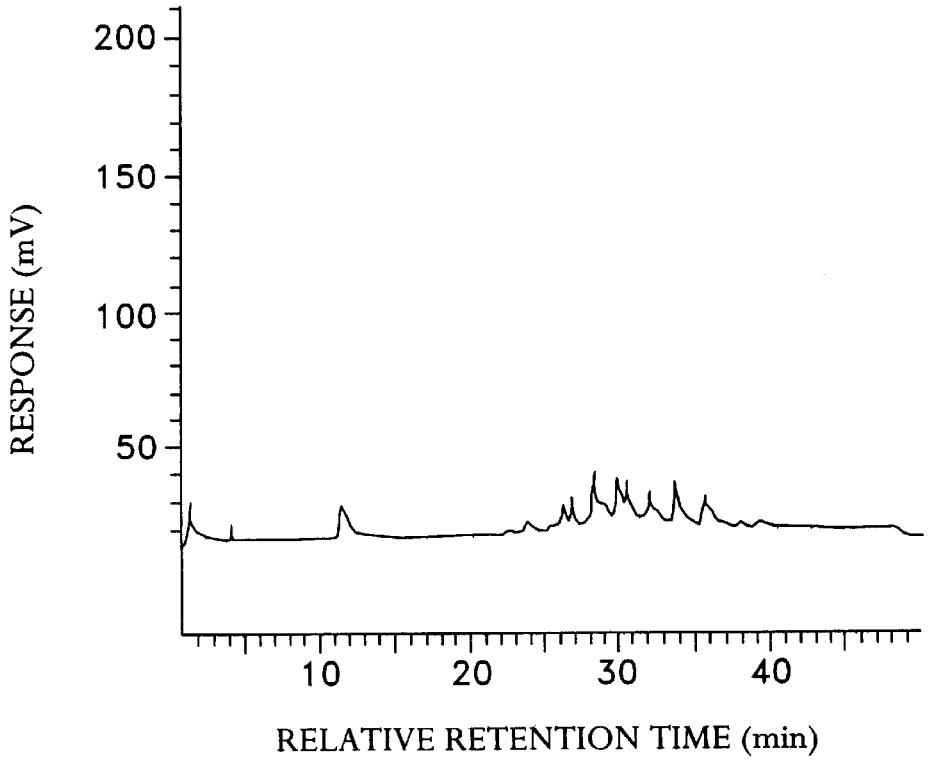
Figure 9C:
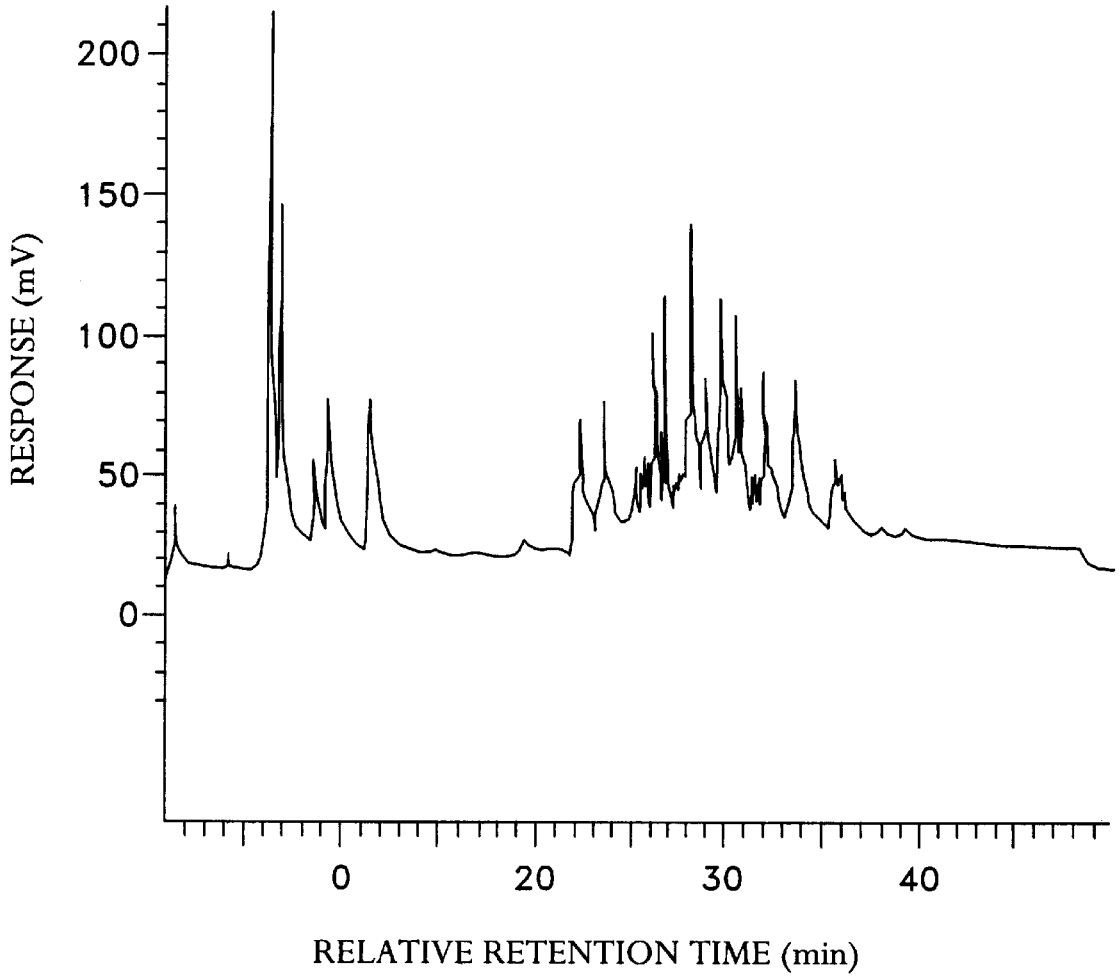
Figure 10A:
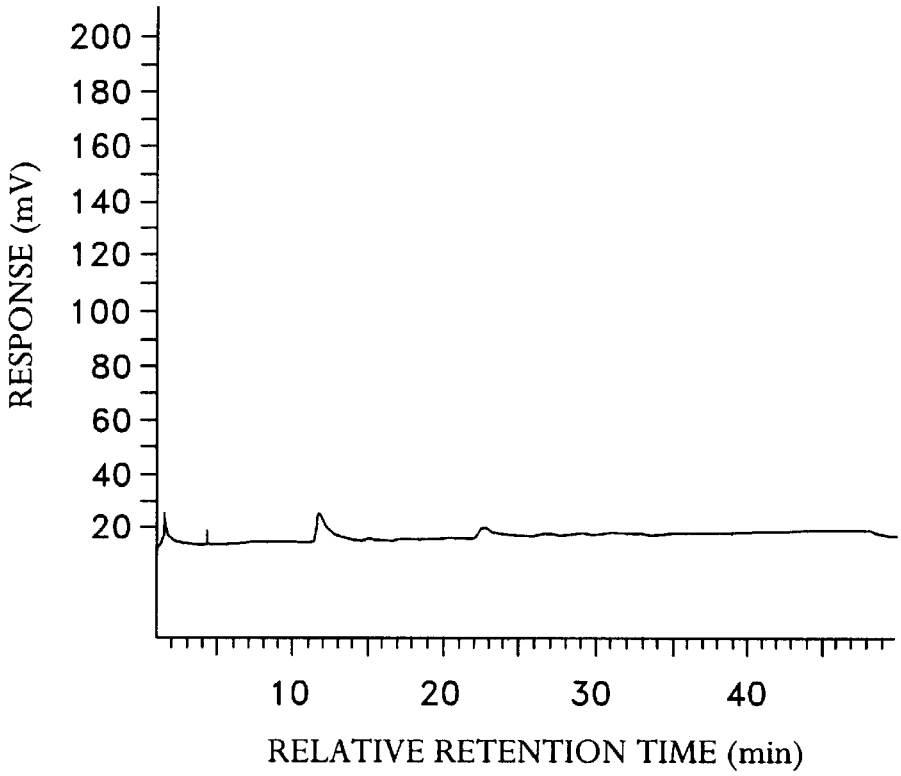
Figure 10B:
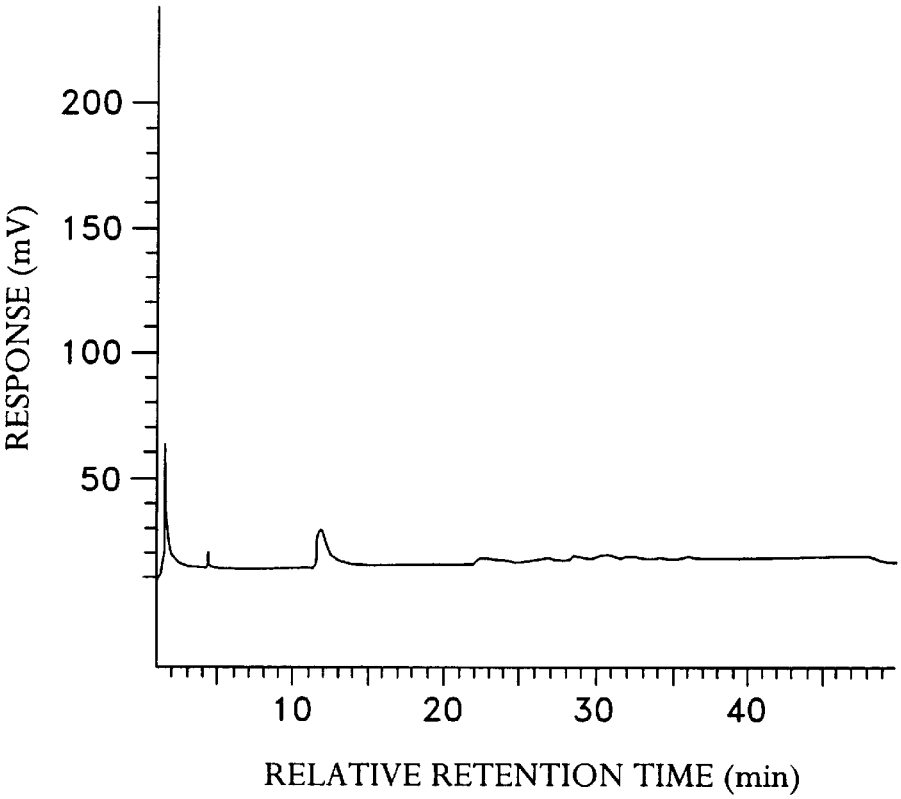
Figure 10C:
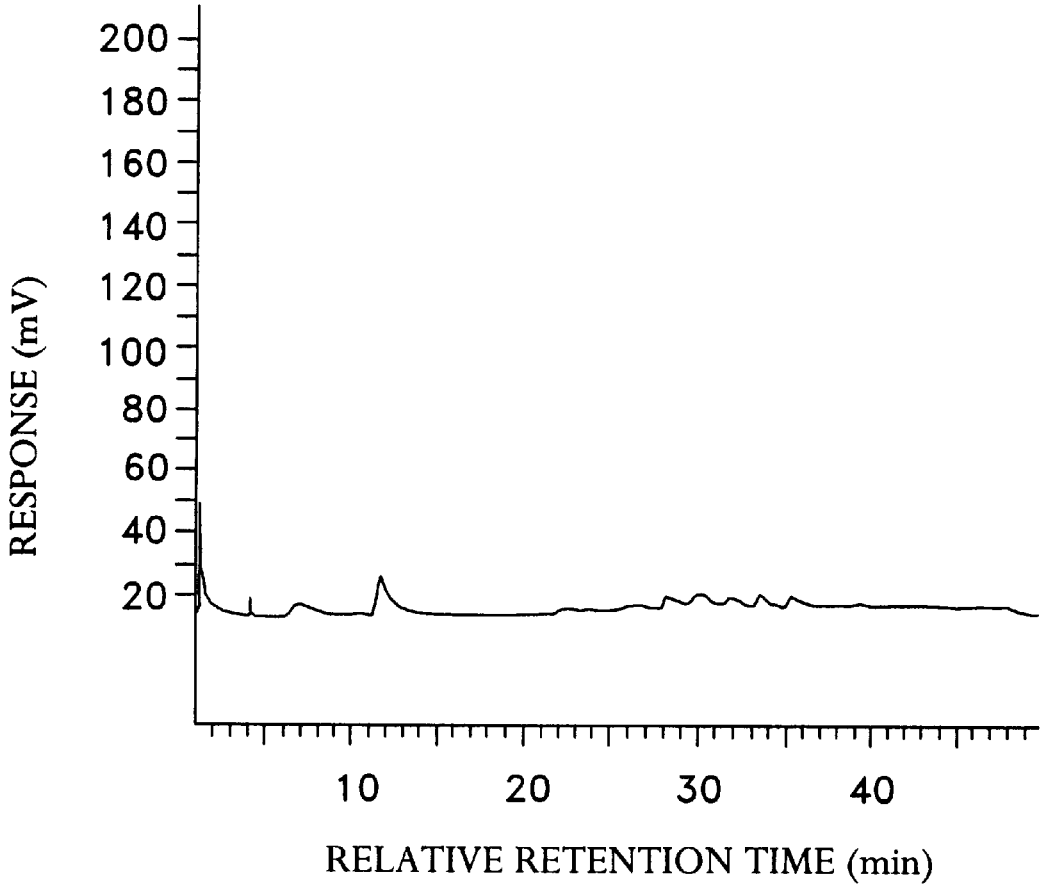

It was observed that the highest destruction efficiency occurs at a minimum loading rate with 10% of carbon loss, as shown in FIGS. 7 and 8.

At higher loading levels, the destruction efficiency decreases, and less carbon loss occurs, as shown again by FIGS. 7 and 8.

In addition, no microcontaminants or toxic oxygenated polychlorinated by-products above detection limits were detected in the trapped effluents or on the regenerated carbon.

Furthermore, it was observed that a minor change in surface area of the carbon adsorbent occurred after repeated regeneration cycles, indicating that the adsorptive capacity of the carbon adsorbent remains largely intact, even after being subject to the process of the invention.

TABLE I

Residual PCB congeners and concentration in exhausted reagent sludge

| Chlorobiphenyl | | Residual PCBs in waste reagent | Chlorobiphenyl | | Residual PCBs in waste reagent |
|---|---|---|---|---|---|
| No. | Structure | (ppm) | No. | Structure | (ppm) |
| 4 | 2,2'- | 8.43 | 48 | 2,2',4,5- | 18.70 |
| 10 | 2,6- | 0.56 | 75 | 2,4,4',6- | 2.51 |
| 7 | 2,4- | 0.60 | 44 | 2,2',3,5'- | 62.72 |
| 9 | 2,5- | 0.54 | 41 | 2,2',3,4- | 15.62 |
| 6 | 2,3' | 3.31 | 64 | 2,3,4',6- | 13.78 |
| 5 | 2,3' | 0.05 | 40 | 2,2',3,3'- | 17.80 |
| 8 | 2,4'- | 6.12 | 74 | 2,4,4',5- | 17.36 |
| 15 | 4,4'- | 1.21 | 66 | 2,3',4,4'- | 6.64 |

TABLE I-continued

Residual PCB congeners and concentration in exhausted reagent sludge

| Chlorobiphenyl | | Residual PCBs in waste reagent | Chlorobiphenyl | | Residual PCBs in waste reagent |
|---|---|---|---|---|---|
| No. | Structure | (ppm) | No. | Structure | (ppm) |
| 17 | 2,2',4- | 2.30 | 95 | 2,2',3,5',6- | 11.48 |
| 18 | 2,2',5- | 5.02 | 91 | 2,2',3,4',6- | 5.58 |
| 25 | 2,3',4- | 86.90 | 56 | 2,3,3',4'- | 17.28 |
| 28 | 2,4,4'- | 33.90 | 60 | 2,3,4,4'- | 14.36 |
| 31 | 2,4',5- | 28.55 | 90 | 2,2',3,4',5- | 4.10 |
| 20 | 2,3,3'- | 2.90 | 101 | 2,2',4,5,5'- | 17.02 |
| 33 | 2',3,4- | 34.49 | 99 | 2,2',4,4',5- | 75.58 |
| 53 | 2,2',4,6' | 4.61 | 97 | 2,2',3',4,5- | 26.52 |
| 22 | 2,3,4'- | 43.65 | 85 | 2,2',3,4,4'- | 7.21 |
| 51 | 2,2',4,6'- | 2.94 | 77 | 3,3',4,4'- | 2.16 |
| 46 | 2,2',3,6- | 13.13 | 110 | 2,3,3',4',6- | 7.34 |
| 52 | 2,2',5,5'- | 45.25 | 105 | 2,3,3',4,4'- | 5.50 |
| 49 | 2,2',4,5'- | 73.44 | 132 | 2,2',3,3',4,6- | 1.92 |
| 47 | 2,2',4,4' | 21.40 | 153 | 2,2',4,4',5,5'- | 4.35 |
| | | | | Total | 774.83 |

TABLE II

Residual PCB congeners and concentrations in carbon after treatment

| Chlorobiphenyl | | 5% (w/w) waste sludge in | 10% (w/w) waste | 20% (w/w) waste sludge in |
|---|---|---|---|---|
| No. | Structure | carbon | sludge in carbon | carbon |
| 25 | 2,3',4- | — | 2.4 | 10.0 |
| 28 | 2,4,4'- | — | 1.0 | 2.9 |
| 31 | 2,4',5- | — | 0.5 | 2.1 |
| 20 | 2,3,3'- | — | 0.02 | 0.3 |
| 33 | 2',3,4- | — | 0.4 | 5.7 |
| 53 | 2,2',5,6'- | — | 0.06 | 0.8 |
| 22 | 2,3,4'- | — | 0.6 | 1.6 |
| 51 | 2,2',4,6'- | — | 0.04 | 0.1 |
| 49 | 2,2',4,5'- | 2.0 | 1.2 | 3.6 |
| 47 | 2,2',4,4'- | — | — | 0.9 |
| 48 | 2,2',4,5- | — | — | 0.8 |
| 75 | 2,4,4',6- | — | — | 0.1 |
| 44 | 2,2',3,5- | — | — | 2.4 |
| 41 | 2,2',3,4- | — | 1.2 | 0.7 |
| 64 | 2,3,4',6- | — | — | 0.7 |
| 91 | 2,2',3,4',6- | — | — | 0.2 |
| 90 | 2,2',3,4',5- | 0.08 | 0.06 | 0.1 |
| 101 | 2,2',4,5,5'- | 0.36 | 0.2 | 0.5 |
| | Total | 2.44 ppm | 7.68 ppm | 33.50 ppm |

EXAMPLE 2

Degradation of Dielectric Askarel—PCB Fluids

Askarel, according to the definition of the International Electrotechnical Commission (IEC), refers to synthetic chlorinated aromatic non-flammable hydrocarbons, used as dielectric materials or media in electrical devices (transformers and capacitors). These fluids are commonly composed of mixtures of polychlorinated biphenyls (PCBs) with or without trichlorobenzenes, depending upon the application requirements. Specific combinations of PCBs (commonly referred to by their commercial formulations: Aroclor®, Phenclor® etc.) and trichlorobenzenes were used for particular applications; e.g. a combination of Aroclor 1260 and trichlorobenzene (60% and 40%, respectively). The production, the use and the disposal of these compounds is subject to a large number of international regulations (OCSE, USEPA, EEC (Directives 76/769–85/467 etc.) and Italian (D.P.R. 216/88 dated May 24, 1988 etc.)) for oils/fluids, machinery and equipment containing or contaminated by PCBs beyond the established threshold limits (typically >50 mg/kg).

Due to their recalcitrant natures, disposal of PCBs, in pure or highly concentrated form is especially problematic in a thermodestruction process. If the process does not occur at very high temperature (>1200° C.) and in a rigidly controlled atmosphere (excess of oxygen; retention time >2 seconds), highly toxic, carcinogen, teratogen and mutagen products, such as poly-chlorinated dibenzo furans (PCDFs) and polychlorinated di-benzo-p-dioxin (PCDDs), are formed. While the known chemical dehalogenation processes are effective and/or economically advantageous on liquid and solid matrices contaminated by PCBs, within certain limits (in typical concentrations up to 2000 mg/kg), the process of the present invention was surprisingly found to be applicable also to the destruction of pure Askarel-PCBs. For this application, low sulphur coke, with specific dimensions (preferably 0.2 to 5 mm) was used as a very low cost particle adsorbent and energy source. The coke was mixed with 10% of dehalogenating reagent in accordance with WO94/14504, to balance the degradation process. The dehalogenating reagent mixed with coke was packed into a ceramic-lined reactor column and impregnated with Askarel introduced with a shower head sprayer. Destruction efficiencies of the process were evaluated at varied Askarel loadings ranging from 5 to 20 percent (w/w) of the total weight support/coke. The process was carried out in a single counterflow thermoxidation cycle at the end of which the coke was recovered or in two thermoxidation phases (first as a counterflow, then forward flow). The coke was consumed during the forward flow phase. A mass balance approach was applied to calculate destruction efficiency. For this purpose, concentrations of residual PCBs, PCDFs, PCDDs and hydrochloric acid (HCl) were determined. Destruction efficiencies in the two-cycle operation were better than 99.999% (FIGS. 9A, 9B, 9C and FIGS. 10A, 10B, 10C). In either single and double mode, PCDDs/PCDFs concentrations were found to be below the method detection limit, which was set at 100 part per trillion (ppt), using gas chromatography with a mass spectrometer (GC/MS) in accordance with U.S.E.P.A. protocols and the analytical methodology of Example 1. Mineralization efficiency, assessed through conversion of organic chlorine to HCl, was surprisingly found to be nearly complete at 98 percent, which was the limit of the analytical methodology.

EXAMPLE 3

Regeneration of Saturated Activated Carbon

Activated carbon is one of the most versatile adsorbents of contaminants of various matrices (oils, drinking water, waste waters, air, etc.), but it is very expensive. When activated carbon becomes saturated, it is necessary to provide for its disposal as a special or toxic/harmful waste, with subsequent high costs. Alternatively, the carbon may be decontaminated and regenerated in specialized centers that are not available in every country. The main limits to regeneration are linked to the remote location of these centers and the associated high fixed and variable costs for treatment, transportation and handling. The oxidative counterflow process of the present invention surprisingly demonstrated its particular efficiency in pursuing this objective in a mode directly sequential to the adsorbing process. The process of the invention is activated as soon as the saturation of the activated carbon with contaminants, adsorbed substances or compounds, is reached. The results obtained with a variety of granular activated carbons demonstrated that the process of the invention is capable of efficiently regenerating these materials with a minimal total material loss of between 5 and 10 percent for each treatment cycle.

Figure 11:
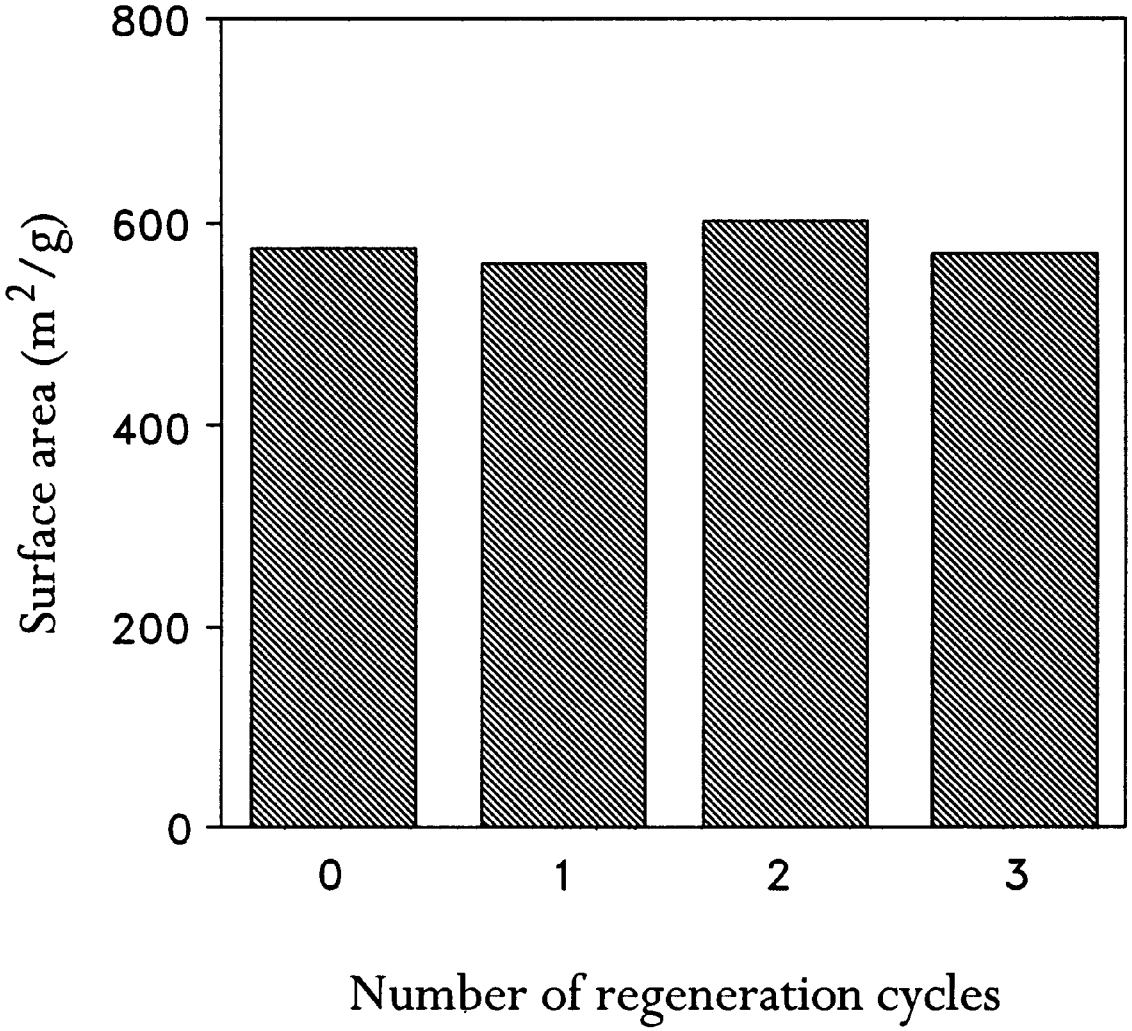
FIG. 11 illustrates the variation of the surface area of Darco active carbon with the number of regeneration cycles, according to Example 3.

Exhaustive experimental tests relative to surface area and to the adsorbing capacity surprisingly demonstrated that the process enhances effectively both adsorbing capacity and active surface area. Results of surface area analysis for a commercially available carbon (Darco Carbon) are shown in FIG. 11. These results were obtained following the methodologies described in Example 1 with reference to the adsorption of nitrogen (BET).

EXAMPLE 4

Destruction of PCBs and Recovery of Aluminum from Electrical Capacitors Impregnated with Askarel The process of this invention was used to recover high grade electrolytic aluminum (typically >30% in weight) from capacitors built with Askarel-PCBs impregnated solid insulation. Capacitor packings are shredded to the correct size (0.5÷50 mm) and mixed to 10 percent in weight with low sulphur content coke. The process, performed in a column type reactor, consumed the paper insulation and destroyed the PCBs, leaving the aluminum largely intact. The aluminum was recovered through a simple sieving operation. Destruction of PCBs during the process was found to be better than 99.999) percent, measured with GC/MS, in accordance with a U.S.E.P.A. protocol and the analysis methodology of Example 1.

EXAMPLE 5

Production of Activated Carbon through the Conversion of the Carbon of Scrap Tires Tens of millions of tires must be scrapped each year. Alternate uses for these materials are being pursued in research and experiments world-wide. Pyrolysis techniques have been utilized to generate useful by-products. One of such by-products is carbon (>30% in weight). The carbon obtained, however, typically contains large amounts of contaminant and dangerous leachable organics. The contaminants and organics are released during traditional treatments, thus making the obtained carbon unfit as a carbon adsorbent. Experiments have shown that this mixture of contaminant leachable organics can be conveniently destroyed through the counterflow oxidative process of this invention, resulting in the production of activated carbon from scrap tires. The porous supports, thus obtained, surprisingly showed surface areas up to 400 $m^2$/gram and adsorptive capacities comparable to many commercial activated carbons, with a very advantageous cost/benefit ratio for decontamination applications. The analysis methodologies used were those described for Example 1.

Naturally it is intended that, maintaining the principle of the invention, the details and embodiments thereof can widely change with respect to what has been described and illustrated in the drawings, without departing from the scope of this invention.

What is claimed is:

1. A process for decontaminating a matrix, comprising the steps of:

filling a first reactor having an end and opposite end with a particulate support comprising a solid matrix or a liquid or gaseous matrix impregnated onto said support, the said matrix being contaminated with halogenated organic compounds;

treating said particulate support with a decontaminating reagent comprising:

(a) one or more metals or metal oxides, (b) a polyalkyleneglycol or a random copolymer of an alkene oxide; and (c) a hydroxide, a C1–C6 alcoholate, or a carbonate or bicarbonate of an alkali metal or alkaline earth metal;

inducing an oxidative flow through the reactor from the reactor end, priming a thermoxidation reaction at the reactor opposite end, so that a flame front having a temperature of at least 1200° C. is generated in the reactor, which flame front moves through the reactor in a direction opposite from the direction of the oxidative flow so as to substantially decompose or destroy the said halogenated organic compounds contained in the matrix, and passing gas and particulate leaving the first reactor following the thermoxidation reaction to the bottom of a second reactor containing a basified liquid.

2. The process according to claim 1 wherein the polyalkyleneglycol has the formula (I)

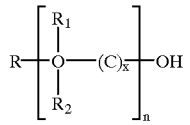

wherein:

x is greater than or equal to 2;

n is an integer from 1 to 500;

R is selected from the group consisting of hydrogen, straight- or branched-chain $C_1$–$C_{20}$ alkyl, aralkyl and acyl;

$R_1$ and $R_2$, same or different, are selected from the group consisting of hydrogen, straight- and branched-chain $C_1$–$C_{20}$ alkyl, substituted and unsubstituted $C_5$–$C_8$ cycloalkyl, and acyl.

3. The process according to claim 1 wherein:

the mole ratio of the polyalkyleneglycol or the random copolymer of alkene oxide to halogen in the matrix to be decontaminated is from 1:1 to 30:1;

the mole ratio of hydroxide or C1–C6 alcoholate to halogen in the matrix to be decontaminated is from 10:1 to 200:1; and the concentration of the metal is from about 0.02% to 5% by weight of the reaction mixture.

4. The process according to claim 1 wherein the matrix to be decontaminated and the decontaminating reagent are mixed, prior to the beginning of the thermoxidation reaction, with a mechanical mixer and with ultrasound.

5. The process according to claim 1 wherein the matrix to be decontaminated and the decontaminating reagent are irradiated by a source of ultraviolet rays, prior to the beginning of the thermoxidation reaction.

6. The process according to claim 1 wherein the impregnation of the particulate support with said liquid or gaseous matrix, and the treatment of the support with said decontaminating reagent, both occur at a temperature between ambient temperature and about 200° C., said impregnation being performed until the particle support becomes saturated with said liquid or gaseous matrix.

7. The process according to claim 1, wherein said particulate support is impregnated by the liquid or gaseous matrix to be decontaminated, prior to the beginning of the thermoxidation reaction.

8. The process according to claim 1, wherein said basified liquid is recirculated through an adsorbing trap comprising a filtering particulate support particulate containing an adsorbing agent, said decontaminating reagent, or a combination thereof.

9. The process according to claim 1 wherein, gas exiting the second reactor passes through a third reactor containing an adsorbing porous material.

10. The process according to claim 9, wherein the gas exiting the third reactor passes through a pyrolytic torch prior to being released into the atmosphere.

11. The process according to claim 9, wherein the first, second and third reactors are of a column type and have a length-to-diameter ratio between 2 and 25.

12. The process according to claim 1, wherein the speed of the displacement of the flame front in the first reactor is such to retain for a time between 2 and 10 seconds in each section of the first reactor the conditions required for the development of the thermoxidation reaction.

13. The process according to claim 1, wherein a new priming of the thermoxidation reaction is generated in the first reactor end when the flame front reaches said end, said new priming being generated in such a manner so as to cause the flame front to move forward in the same direction as the oxidative flow in said first reactor.

14. The process according to claim 1, wherein said particulate support is porous and is selected from the group consisting of carbon, coke, activated carbon, activated alumina, nonactivated alumina, silica gel, fuller's earth, diatomaceous earth, pumice, zeolite, perlite, molecular sieves, said decontaminating reagent, silicates, functional ceramic, nonfunctional ceramic, sand, clay, metallic powders, sintered powders, metal oxides, filtration media, vegetable media and mixtures thereof.

15. The process according to claim 14, wherein the average granularity of said particulate support is between 0.01 and 250 mm.

16. The process according to claim 1, wherein said oxidative flow is of air or oxygen.

17. A process according to claim 1, in which said particulate support, said decontaminating reagent, or both is pre-formed on functional beds which are in the form of columns or cartridges.

* * * * *